United States Patent [19]

Fry

[11] Patent Number: 4,607,503

[45] Date of Patent: Aug. 26, 1986

[54] COMPRESSOR MOUNTED SUCTION ACCUMULATOR

[75] Inventor: Emanuel D. Fry, Tecumseh, Mich.

[73] Assignee: Tecumseh Products Company, Tecumseh, Mich.

[21] Appl. No.: 781,103

[22] Filed: Sep. 27, 1985

[51] Int. Cl.[4] ..... F25B 43/00

[52] U.S. Cl. ..... 62/503; 62/295; 62/297

[58] Field of Search ..... 62/503, 295, 297

[56] References Cited

U.S. PATENT DOCUMENTS

| | | | |
|---|---|---|---|
| 1,835,569 | 12/1931 | Lipman | 62/503 |
| 1,835,785 | 12/1931 | Kellogg | 62/503 |
| 2,155,059 | 4/1939 | Philipp | 62/503 |
| 2,548,335 | 4/1951 | Balogh | 62/503 |
| 2,623,607 | 12/1952 | Bottum | 62/503 |
| 2,880,597 | 4/1959 | Wellborn | 62/297 |
| 2,935,279 | 5/1960 | LaPorte et al. | 62/295 |
| 3,012,414 | 12/1961 | LaPorte et al. | 62/503 |
| 3,370,440 | 2/1968 | Kellie | 62/503 |
| 3,488,678 | 1/1970 | Wagner | 62/503 |
| 3,754,409 | 8/1973 | Wreen, Jr. et al. | 62/503 |
| 3,872,689 | 3/1975 | Bottum | 62/503 |
| 3,938,353 | 1/1976 | Wrenn, Jr. et al. | 62/503 |

FOREIGN PATENT DOCUMENTS 437263 1/1926 Fed. Rep. of Germany .

5341847 9/1976 Japan .

*Primary Examiner*—Ronald C. Capossela

*Attorney, Agent, or Firm*—Albert L. Jeffers; Anthony Niewyk

[57] ABSTRACT

A compressor and suction accumulator assembly wherein the suction accumulator is mounted on the casing of the compressor. The accumulator includes a cylindrical casing having two end walls. A first end wall includes an inlet aperture and the second end wall includes an outlet aperture. The second end wall is circular and substantially flat and has a thickness greater than the casing of the accumulator. The outlet aperture in the circular second end wall is spaced radially outwardly from the center of the second end wall near the periphery thereof and is spaced further outwardly from the compressor casing than the center of the circular end wall. A suction tube extends through the outlet aperture into the accumulator casing and is bent inwardly toward the center of the accumulator casing whereby the inlet opening of the suction tube is disposed coaxially with the cylindrical casing of the accumulator. The other end of the suction tube is bent at right angles with respect to the first end and extends into the compressor casing. The assembly may also further include a screen dispose between the inlet and outlet apertures of the accumulator casing.

13 Claims, 4 Drawing Figures

COMPRESSOR MOUNTED SUCTION ACCUMULATOR

BACKGROUND OF THE INVENTION

This invention relates to refrigerant compressors and in particular to a suction accumulator and the assembly of a suction accumulator and a refrigeration compressor.

Suction accumulators are well known in the refrigeration art and are provided in refrigeration systems to prevent liquid refrigerant from entering the compressor cylinder and thereby causing slugging of the compressor. Such accumulators act as storage reservoirs for liquid refrigerant. The accumulators are constructed to cause the stored liquid refrigerant to flash off into the gaseous state prior to entering the compressor suction tube and the compressor cylinder. This invention relates to a suction accumulator and the assembly of such an accumulator to the housing of a compressor.

Many prior art arrangements have been provided for mounting accumulators in refrigeration systems. However, in the interest of providing a compact refrigeration system and for ease of manufacturing, it is preferable that suction accumulators are mounted directly on the compressor housings. Furthermore, in the interest of achieving a compact refrigeration system it is desired that the space between suction accumulators and the compressor housings be kept very small.

A further desirable feature of a refrigeration system is that very little pressure drop occurs in the suction tube so that suction tube losses will not detract appreciably from the efficiency of the refrigeration system. In order to prevent appreciable pressure drop in the suction tube it is desirable that the length of the suction tube is kept as short as possible and furthermore that the diameter of the suction tube is made as large as possible. In the prior art suction accumulator mounting arrangements these objects have not been achieved. Conventionally a suction accumulator comprises a cylindrical housing having two end walls. The suction tube enters one end wall. Conventionally these end walls have been convex or of frusto-conical shape. One end of the suction tube extends into the accumulator through a central aperture of the end wall. The other end of the suction tube is connected to the casing of the compressor. The suction tube therefore includes a bent portion and the radius of the bent portion is a function of the diameter of the suction tube and the diameter of the accumulator. One such prior art accumulator mounting arrangement is disclosed in copending patent application Ser. No. 670,306 filed Nov. 13, 1984 and assigned to the assignee of record of the present application. In the interest of keeping this prior art assembly compact, the diameter of the suction tube has been made small so that the suction tube can accommodate the rather sharp bend from the accumulator to the compressor housing. This has led to an undesirable pressure drop in the suction tube. It is therefore desired to provide an accumulator mounting arrangement whereby the diameter of the suction tube is maximized.

Another disadvantage of prior art suction accumulator and compressor assemblies has been that the end wall thickness of the accumulator has been relatively thin in order to use a minimum of materials. The problem with this construction is that noise generated by the operation of the compressor has tended to be amplified by this bottom portion of the accumulator which acts as a "drum skin" and resonates at the noise pulse frequency of the compressor. It is therefore desired to provide an accumulator which attenuates rather than amplifies the noise generated by the compressor.

SUMMARY OF THE INVENTION

The present invention overcomes the disadvantages of the above described prior art compressor and accumulator assemblies by providing an improved assembly therefor. The accumulator of the present invention, in one form thereof, comprises a cylindrical housing having two end walls. One of the end walls includes an inlet aperture and the other end wall includes an outlet aperture. The end wall which includes the outlet aperture comprises a substantially flat circular surface with the outlet aperture located abaxially with respect to the center of the circular surface. The outlet aperture is spaced further away from the compressor housing than the center of the circular end wall. The suction tube enters the outlet aperture at substantially right angles to the plane of the end wall. The other end of the suction tube is arranged parallel to the end wall and enters the compressor housing. By this abaxial asymmetric arrangement of the suction tube with respect to the center of the suction accumulator end wall the diameter of the suction tube can be maximized as the radius of the bend in the suction tube is maximized for the given diameter of the accumulator.

An advantage of the accumulator according to the present invention is its compactness and the minimized pressure loss associated with the suction tube which connects the accumulator with the compressor.

Another advantage of the assembly is that the noise pulses generated by the compressor are attenuated by the accumulator.

The present invention, in one form thereof, comprises a combination of a compressor having a housing and an accumulator mounted on a housing. The accumulator includes a tubular casing and first and second end walls therefor. The first end wall includes an inlet aperture, and the second end wall is substantially flat and includes an outlet aperture therein. The outlet aperture is located in the part of the second end wall which is most remote with respect to the compressor housing. A flat end of the suction tube extends through the outlet aperture into the accumulator casing abaxial to and substantially parallel to the axis of the casing. A second end of the suction tube extends into the compressor housing at substantially right angles to the first end.

The present invention in one form thereof, further provides a compressor and accumulator assembly wherein the compressor includes a casing and the accumulator includes a cylindrical housing portion mounted on the casing in parallel relationship to the axis of the housing and in closely spaced relationship to the compressor casing. The accumulator housing includes first and second end walls and inlet and outlet apertures respectively therein. The second end wall is substantially circular and flat and has a greater wall thickness than the accumulator housing. A suction tube having a first end portion is offset from and substantially parallel to the axis of the accumulator housing and extends through the second end wall into the accumulator housing. The end opening of the second tube end is substantially coaxial with the axis of the accumulator housing. The second end portion of the tube is bent at right angles to the first portion and is secured to the compressor casing.

It is therefore an object of the invention to provide an accumulator which may be mounted on a compressor housing whereby the diameter of the suction tube connecting the accumulator to the compressor is maximized.

Another object of the invention is to provide a suction accumulator and compressor assembly whose efficiency is maximized.

Yet another object of the invention is to provide an accumulator which attenuates the noise generated by the compressor.

BRIEF DESCRIPTION OF THE DRAWINGS

The above mentioned and other features and objects of this invention and the manner of obtaining them will become more apparent, and the invention itself will be better understood by reference to the following description of an embodiment of the invention, taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
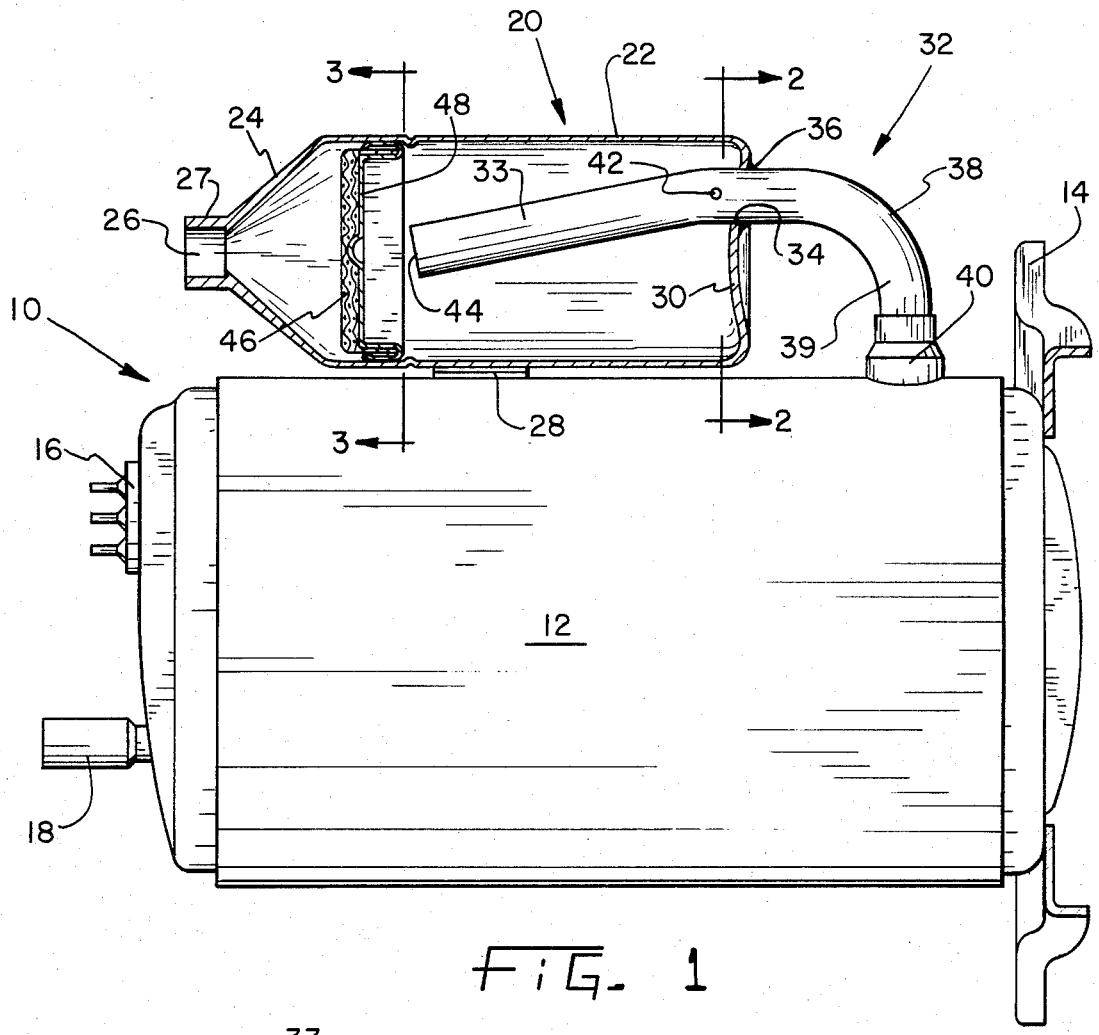
FIG. 1 is an elevational view, partly in cross-section, of a compressor assembly including a suction accumulator and a suction tube.

Referring to FIG. 1, a compressor 10 is shown including a compressor casing or housing 12 with compressor mounting brackets 14 attached thereto. The compressor housing or shell is also provided with an electrical terminal 16 for connection to a source of electric energy. Discharge outlet 18 is provided for connection to a condenser of the refrigeration system in a conventional manner.

Figure 2:
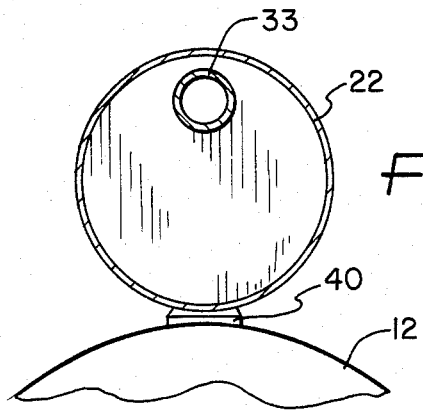
FIG. 2 is a sectional view taken along line 2—2 of FIG. 1 showing the suction tube and the accumulator.
Figure 3:
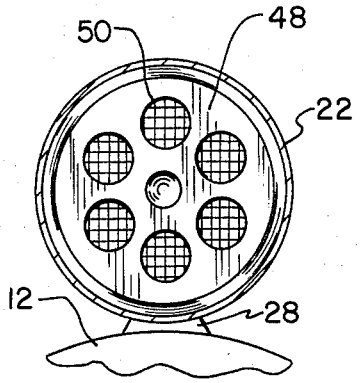
FIG. 3 is a sectional view taken along line 3—3 of FIG. 1 showing the suction accumulator screen and housing.
Figure 4:
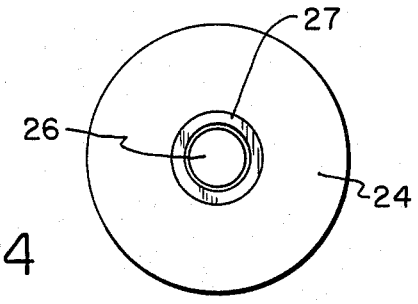
FIG. 4 is an end view taken from the left hand side of the accumulator of FIG. 1.

An accumulator 20 is shown including an accumulator casing 22 which preferably is cylindrical in shape as best seen in FIG. 2. The accumulator also includes a conical end wall 24 having a tubular portion 27 including inlet aperture 26. The accumulator casing 22 is secured to the compressor housing 12 by means of a mounting bracket 28. Preferably the spacing between the accumulator casing 22 and the compressor casing 12 is as small as possible for optimum compactness of the assembly. The accumulator 20 also includes an end wall 30 which is substantially flat and disc-shaped and may be formed integrally with cylindrical accumulator casing 22. It should be noted that the thickness of the end wall or bottom portion 30 of the accumulator is substantially greater than the thickness of the cylindrical side wall of accumulator casing 22. By providing a thick and therefore stiff end wall 30, noise pulses generated by the compressor as it compresses refrigerant gas will not be amplified by the flat drum-like bottom 30 of the accumulator. Rather the stiff, relatively inflexible bottom will have a relatively high natural resonance frequency whereby the low frequency components of the noise generated by the compressor will be attenuated. Since the low frequencies are especially objectionable, the apparent noise generated by the compressor will appear to be attenuated.

The accumulator casing may be manufactured of any suitable material, such as aluminum or copper for corrosion resistance and to facilitate connection the accumulator to the lines of the refrigeration system by soldering or the like.

A first end portion 33 of a suction tube 32 is shown extending into accumulator 20 through an aperture 34 in end wall 30. It should be noted that this aperture is located near the periphery of end wall 30, asymmetrically with respect to the center of bottom 30 and therefor is abaxial with respect to end wall 30. Suction tube 32 is secured to bottom 30 by means of soldering or brazing or the like as at 36 and forms a sealed connection with bottom 30 to prevent escape of gas or liquid from accumulator 22. The first end portion 33 of the suction tube 32 extends into the accumulator and is slightly bent so that the suction tube inlet 44 is located substantially centrally of casing 22.

Suction tube 32 also includes a bend or elbow portion 38 whereby bent portion 39 of suction tube 32 extends at substantially right angles to portion 33. End portion 39 may be connected to compressor housing 12 by means of a suction inlet adapter 40. It should be noted that, by virtue of the eccentric location of aperture 34, the radius of tube elbow 38 can be maximized for the particular diameter of accumulator casing 22. The radius of elbow 38 of tube 32 is limited by the size of the tube diameter. If too small a radius is chosen, the tube will flatten and be pinched shut and restrict the flow of refrigerant and cause an undesirable pressure drop. The diameter of tube 32 can therefore be maximized for the particular diameter of accumulator casing 22 since by the abaxial location of aperture 34, the radius of bend 38 is maximized. This is a great advantage since the large diameter of tube 42 minimizes the pressure drop through tube 32 and thereby maximizes the efficiency of the refrigeration system.

Accumulator 20 also includes a screen 46 supported by a screen support 48 whereby any impurities in the refrigerant will be filtered out by screen 46 prior to the entry of refrigerant into tube 32. Tube 32 is also provided with a small aperture 42 for aspirating a small amount of liquid refrigerant into suction tube 32. Upon aspiration, the liquid refrigerant flashes into its gaseous state.

By way of example, in a preferred embodiment the diameter of accumulator casing 22 is in the range of 2 inches to $2\frac{1}{2}$ inches. The diameter of tube 32 is in the range of $\frac{1}{4}$ inches to $\frac{5}{8}$ inches, and the radius of elbow 38 is in the range of $1\frac{1}{8}$ inches to $1\frac{1}{4}$ inches.

In operation, refrigerant, both liquid and gaseous, will enter accumulator 20 from the evaporator (not shown) of the refrigeration system. Liquid refrigerant flows through screen 46 into the bottom portion of accumulator 20. Gaseous refrigerant enters into suction tube inlet 44 and flows to the compressor 12. A small amount of liquid refrigerant will be aspirated into tube 32 through aperture 42 and flashes into the gaseous state.

By virtue of the maximization of the radius of elbow 38 by the off center location of aperture 34 the accumulator compressor assembly is extremely compact and highly efficient.

While this invention has been described as having a preferred design, it will be understood that it is capable of further modification. This application is therefore intended to cover any variations, uses, or adaptations of the invention following the general principles thereof and including such departures from the present disclosure has come within known or customary practice in the art to which the invention pertains and fall within the limits of the appended claims.

What is claimed is:

1. In combination, a hermetic compressor having a housing, an accumulator mounted on said housing in closely spaced relationship thereto, said accumulator having a cylindrical casing, a first end wall including an inlet aperture, and a second end wall including an outlet aperture, a screen disposed inside said accumulator casing, said second end wall having a greater wall thickness than said accumulator casing, said outlet aperture being located eccentrically with respect to the center of said second end wall and spaced outwardly of said center with respect to said housing, a suction tube having one end portion extending through said outlet aperture into said accumulator casing and disposed at substantially right angles to said second end wall, the open end of said one end portion disposed substantially coaxially with said accumulator casing, a second end portion of said tube disposed at substantially 90° with respect to said first end portion and extending into said compressor housing, said tube having a diameter in the range of $\frac{1}{2}$ inches to $\frac{5}{8}$ inches and said accumulator casing having a diameter in the range of 2 inches to $2\frac{1}{2}$ inches.

2. The accumulator of claim 1 wherein an elbow portion connects said tube first and second end portions, said elbow having a radius in the range of $1\frac{1}{8}$ inches to $1\frac{1}{4}$ inches.

3. The accumulator according to claim 1 wherein the end portion of said first suction tube end is disposed near the center of said screen.

4. In combination a compressor having a housing and an accumulator mounted on said housing, said accumulator comprising:

a tubular casing and first and second end walls therefor;

said first end wall including an inlet aperture, said second end wall being substantially flat and including an outlet aperture therein; said outlet aperture located at the periphery of said second end wall remote from said compressor housing; and a suction tube having a first end extending through said outlet aperture into said accumulator casing, said first end being substantially abaxial and parallel to the axis of said casing and a second end extending into said compressor housing at substantially right angles to said first end.

5. The accumulator according to claim 4 wherein said second end wall has a greater wall thickness than said tubular casing.

6. The accumulator according to claim 4 wherein said second end wall is circular.

7. The accumulator according to claim 6 wherein the diameter of said tube is in the range of $\frac{1}{2}$ inches to $\frac{5}{8}$ inches and the diameter of said second end wall is in the range of 2 inches to $2\frac{1}{2}$ inches.

8. The accumulator according to claim 6 wherein said tube first and second ends are connected by an elbow and wherein the radius of said elbow is in the range of $1\frac{1}{8}$ inches to $1\frac{1}{4}$ inches and the diameter of said tube is in the range of $\frac{1}{4}$ inches to $\frac{5}{8}$ inches.

9. The accumulator according to claim 4 including a screen disposed in said casing, the end portion of said first suction tube end disposed near the center of said screen.

10. A compressor and accumulator assembly, said compressor including a casing, said accumulator including a cylindrical housing portion mounted on said casing axially parallel thereto and in closely spaced relationship therewith, said accumulator housing including first and second end walls and inlet and outlet apertures respectively disposed therein, said second end wall being substantially circular and flat and having a greater wall thickness than said accumulator housing, a suction tube having a first end portion extending through said second end wall into said accumulator housing said first end being substantially parallel to and offset from the axis of said housing, the end opening of said second tube being substantially coaxial with the axis of said accumulator housing, a second end portion of said tube extending at right angles to said first portion and secured to said compressor casing and an elbow portion connecting said first and second portions.

11. The accumulator according to claim 10 wherein the diameter of said tube is in the range of $\frac{1}{2}$ inches to $\frac{5}{8}$ inches and the diameter of said second end wall is in the range of 2 inches to $2\frac{1}{2}$ inches.

12. The accumulator of claim 10 wherein the radius of said elbow is in the range of $1\frac{1}{8}$ inches to $1\frac{1}{4}$ inches and the diameter of said tube is in the range of $\frac{1}{2}$ inches to $\frac{5}{8}$ inches.

13. The accumulator according to claim 10 including a screen disposed in said accumulator housing, the open end of said first suction tube end disposed near the center of said screen.

* * * * *